US009249533B2

(12) United States Patent
Imaizumi

(10) Patent No.: US 9,249,533 B2
(45) Date of Patent: Feb. 2, 2016

(54) SEWING MACHINE

(71) Applicant: BROTHER KOGYO KABUSHIKI KAISHA, Nagoya-shi, Aichi-ken (JP)

(72) Inventor: Kazutaka Imaizumi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 14/703,322

(22) Filed: May 4, 2015

(65) Prior Publication Data

US 2015/0345056 A1 Dec. 3, 2015

(30) Foreign Application Priority Data

May 27, 2014 (JP) ..... 2014-108973

(51) Int. Cl.
*D05C 5/02* (2006.01)
*D05B 19/08* (2006.01)
*D05B 19/10* (2006.01)

(52) U.S. Cl.
CPC ..... *D05B 19/08* (2013.01); *D05B 19/10* (2013.01)

(58) Field of Classification Search
CPC ..... D05C 5/00; D05C 5/02
USPC ..... 700/136–138; 112/470.01, 470.04
See application file for complete search history.

(56) References Cited

U.S. PATENT DOCUMENTS 4,998,489 A * 3/1991 Hisatake et al. ..... 112/103
5,323,722 A * 6/1994 Goto et al. ..... 112/102.5
5,855,176 A * 1/1999 Takenoya et al. ..... 112/102.5
5,911,182 A * 6/1999 Uyama et al. ..... 112/102.5
6,263,815 B1 * 7/2001 Furudate ..... 112/470.13
8,061,286 B2 * 11/2011 Hirata et al. ..... 112/470.01
8,091,493 B2 * 1/2012 Tokura ..... 112/470.01
2008/0247651 A1 10/2008 Takaki et al.
2009/0188413 A1 * 7/2009 Hirata et al. ..... 112/103
2009/0188414 A1 * 7/2009 Tokura ..... 112/457
2015/0005921 A1 * 1/2015 Abe ..... 700/138

FOREIGN PATENT DOCUMENTS

JP H11-267379 A 10/1999
JP 4988408 B2 8/2012

OTHER PUBLICATIONS

Fujiyoshi, Hironobu, "Gradient-Based Feature Extraction SIFT and HOG", Information Processing Society of Japan, Research Report CVIM 160, pp. 211 to 224, Sep. 2007.

* cited by examiner

*Primary Examiner* — Nathan Durham
(74) *Attorney, Agent, or Firm* — Oliff PLC

(57) ABSTRACT

A sewing machine includes a sewing portion, an image capturing portion, a first memory, a processor, and a second memory. The sewing portion is configured to sew an embroidery pattern on a sewing workpiece. The image capturing portion is configured to capture an image. The first memory is configured to store embroidery pattern data, editing parameters, and first feature information. The second memory is configured to store computer-readable instructions. The computer-readable instructions, when executed by the processor, cause the sewing machine to perform processes that include causing the image capturing portion to capture an image including the sewn embroidery pattern, extracting second feature information from a captured image, identifying the sewn embroidery pattern, based on the first feature information and the second feature information, identifying an editing parameter corresponding to the identified embroidery pattern, and causing the sewing portion to sew the identified embroidery pattern using the identified editing parameter.

6 Claims, 12 Drawing Sheets

FIG. 4

90

| EMBROIDERY PATTERN TYPE | EMBROIDERY PATTERN DATA | LOCAL FEATURE QUANTITY SET | HISTOGRAM | AVERAGE ANGLE VALUE | AVERAGE SIZE VALUE |
|---|---|---|---|---|---|
| LETTER K | FIRST EMBROIDERY PATTERN DATA | FIRST FEATURE QUANTITY SET | FIRST HISTGRAM | R1 | T1 |
| LETTER L | SECOND EMBROIDERY PATTERN DATA | SECOND FEATURE QUANTITY SET | SECOND HISTGRAM | R2 | T2 |
| FLOWER | THIRD EMBROIDERY PATTERN DATA | THIRD FEATURE QUANTITY SET | THIRD HISTGRAM | R3 | T3 |
| CAR | FOURTH EMBROIDERY PATTERN DATA | FOURTH FEATURE QUANTITY SET | FOURTH HISTGRAM | R4 | T4 |
| ⋮ | ⋮ | ⋮ | ⋮ | ⋮ | ⋮ |

FIG. 6

91

| EMBROIDERY PATTERN TYPE | EDITING PARAMETER |
|---|---|
| LETTER K | FIRST EDITING PARAMETERS |
| LETTER K | SECOND EDITING PARAMETERS |
| LETTER L | THIRD EDITING PARAMETERS |
| LETTER L | FOURTH EDITING PARAMETERS |
| LETTER L | FIFTH EDITING PARAMETERS |
| FLOWER | SIXTH EDITING PARAMETERS |
| CAR | SEVENTH EDITING PARAMETERS |
| ⋮ | ⋮ |

SEWING MACHINE

CROSS-REFERENCE TO RELATED APPLICATION

This application claims priority to Japanese Patent Application No. 2014-108973 filed May 27, 2014, the content of which is hereby incorporated herein by reference.

BACKGROUND

The present disclosure relates to a sewing machine that is capable of sewing an embroidery pattern.

A sewing machine is known that can edit embroidery data of an embroidery pattern. For example, in a known sewing machine, if an editing parameter is set that is to be used to edit the embroidery data of the embroidery pattern, the sewing machine associates the editing parameter with the embroidery pattern and stores the associated data in a memory. A user may operate the sewing machine to select the embroidery pattern and the editing parameter that are stored in the memory. The sewing machine sews the selected embroidery pattern using the selected editing parameter.

SUMMARY

The numbers of the embroidery patterns and the editing parameters that are stored in the memory may become large. In this case, in the above-described sewing machine, it may be difficult for the user to identify the embroidery pattern sewn in the past and the editing parameter.

Embodiments of the broad principles derived herein provide a sewing machine that allows easy identification of an embroidery pattern and an editing parameter.

Embodiments provide a sewing machine that includes a sewing portion, an image capturing portion, a first memory, a processor, and a second memory. The sewing portion is configured to sew an embroidery pattern on a sewing workpiece. The image capturing portion is configured to capture an image. The first memory is configured to store embroidery pattern data, editing parameters, and first feature information. The embroidery pattern data includes information for sewing respective types of embroidery patterns. The editing parameters are parameters used to edit the embroidery pattern data corresponding to the respective types of embroidery patterns. The first feature information is information that indicates features of the respective types of embroidery patterns. The second memory is configured to store computer-readable instructions. The computer-readable instructions, when executed by the processor, cause the sewing machine to perform processes that include causing the image capturing portion to capture an image including the embroidery pattern sewn on the sewing workpiece, extracting second feature information from a captured image, the second feature information being information that indicates a feature of the sewn embroidery pattern, and the captured image being the image captured by the image capturing portion, identifying the sewn embroidery pattern, based on the first feature information stored in the first memory and the extracted second feature information, identifying an editing parameter corresponding to the identified embroidery pattern, from among the editing parameters stored in the first memory, and causing the sewing portion to sew the identified embroidery pattern using the identified editing parameter.

BRIEF DESCRIPTION OF THE DRAWINGS

Embodiments will be described below in detail with reference to the accompanying drawings in which:

FIG. 4 is a data configuration diagram of an associated data table;

FIG. 6 is a data configuration diagram of a parameter data table;

DETAILED DESCRIPTION

Figure 1:
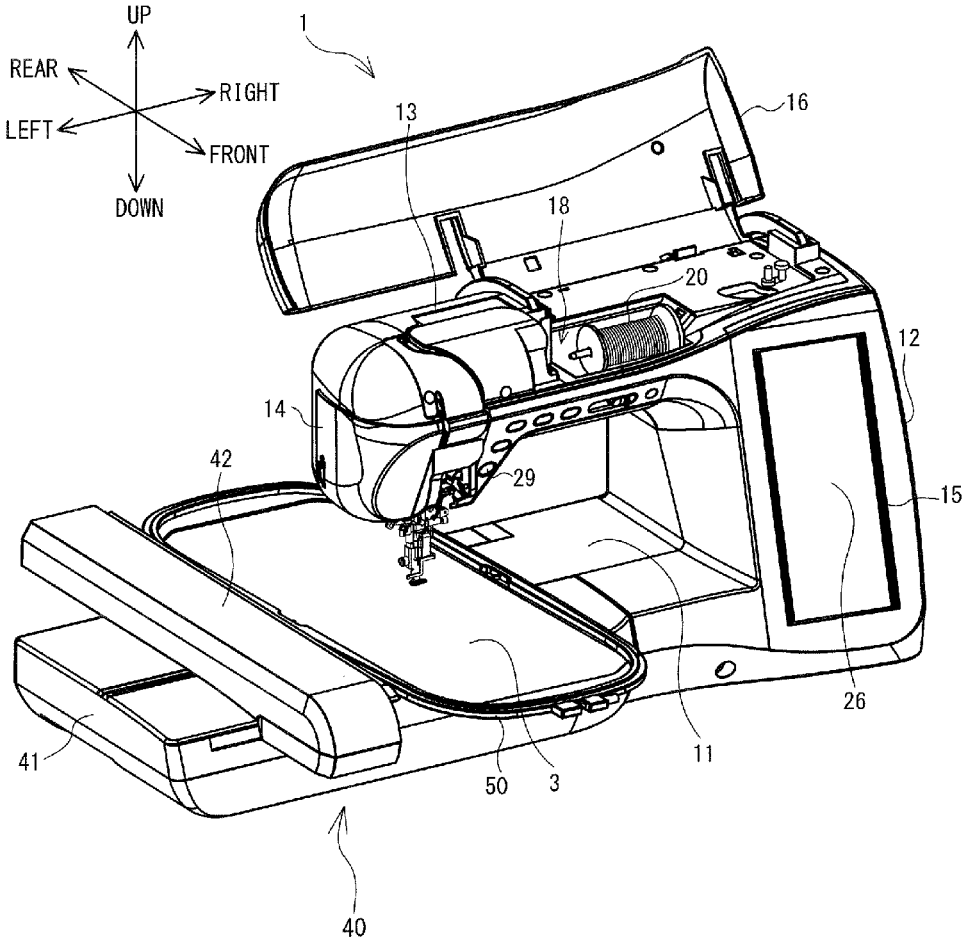
FIG. 1 is a perspective view of a sewing machine.

Embodiments will be explained with reference to the drawings. A physical configuration of a sewing machine 1 will be explained with reference to FIG. 1 and FIG. 2. The up-down direction, the lower right, the upper left, the lower left, and the upper right of FIG. 1 respectively correspond to the up-down direction, the front, the rear, the left, and the right of the sewing machine 1. In other words, a surface on which a display 15 is disposed is a front surface of the sewing machine 1. A longer direction of a bed 11 and an arm 13 is the left-right direction of the sewing machine 1. A side on which a pillar 12 is disposed is the right side of the sewing machine 1. A direction in which the pillar 12 extends is the up-down direction of the sewing machine 1.

As shown in FIG. 1, the sewing machine 1 includes the bed 11, the pillar 12, the arm 13, and a head 14. The bed 11 is a base portion of the sewing machine 1 and extends in the left-right direction. The pillar 12 extends upward from the right end portion of the bed 11. The arm 13 extends to the left from the upper end portion of the pillar 12 such that the arm 13 is opposed to the bed 11. The head 14 is a portion that is connected to the left leading end portion of the arm 13.

A needle plate 21 (refer to FIG. 2) is provided on the top surface of the bed 11. The needle plate 21 has a needle hole (not shown in the drawings). The sewing machine 1 includes a feed dog, a feed mechanism, a shuttle mechanism, and the like, which are not shown in the drawings, underneath the needle plate 21 (namely, inside the bed 11). In a case where normal sewing, which is not embroidery sewing, is performed, the feed dog may be driven by the feed mechanism to feed a sewing workpiece, such as a work cloth, by a specified feed amount. The shuttle mechanism may cause an upper thread (not shown in the drawings) to be entwined with a lower thread (not shown in the drawings), underneath the needle plate 21.

The sewing machine 1 further includes an embroidery frame movement mechanism (hereinafter referred to as a movement mechanism) 40. The movement mechanism 40 may be mounted on and removed from the bed 11 of the sewing machine 1. FIG. 1 shows a state in which the movement mechanism 40 is mounted on the sewing machine 1. In a case where the movement mechanism 40 is mounted on the sewing machine 1, the movement mechanism 40 and the sewing machine 1 are electrically connected. The movement mechanism 40 includes a main body portion 41 and a carriage 42. The carriage 42 is provided above the main body portion 41. The carriage 42 has a substantially rectangular parallelepiped shape that is long in the front-rear direction. The carriage 42 includes a frame holder (not shown in the drawings), a Y axis movement mechanism (not shown in the drawings), and a Y axis motor 84 (refer to FIG. 3). The frame holder is provided on the right side surface of the carriage 42. One of a plurality of types of embroidery frames may be mounted on or removed from the frame holder. An embroidery frame 50 is an embroidery frame having a known structure that holds the sewing workpiece using an inner frame and an outer frame. In a case where the embroidery frame 50 has been moved to a sewing position illustrated in FIG. 1, a sewing workpiece 3 (refer to FIG. 2) held by the embroidery frame 50 is disposed above the needle plate 21 and below a needle bar 6 and a presser foot 9, which will be explained below. The Y axis movement mechanism may move the frame holder in the front-rear direction (a Y axis direction). By the frame holder being moved in the front-rear direction, the embroidery frame 50 may move the sewing workpiece 3 in the front-rear direction. The Y axis motor 84 may drive the Y axis movement mechanism.

Figure 3:
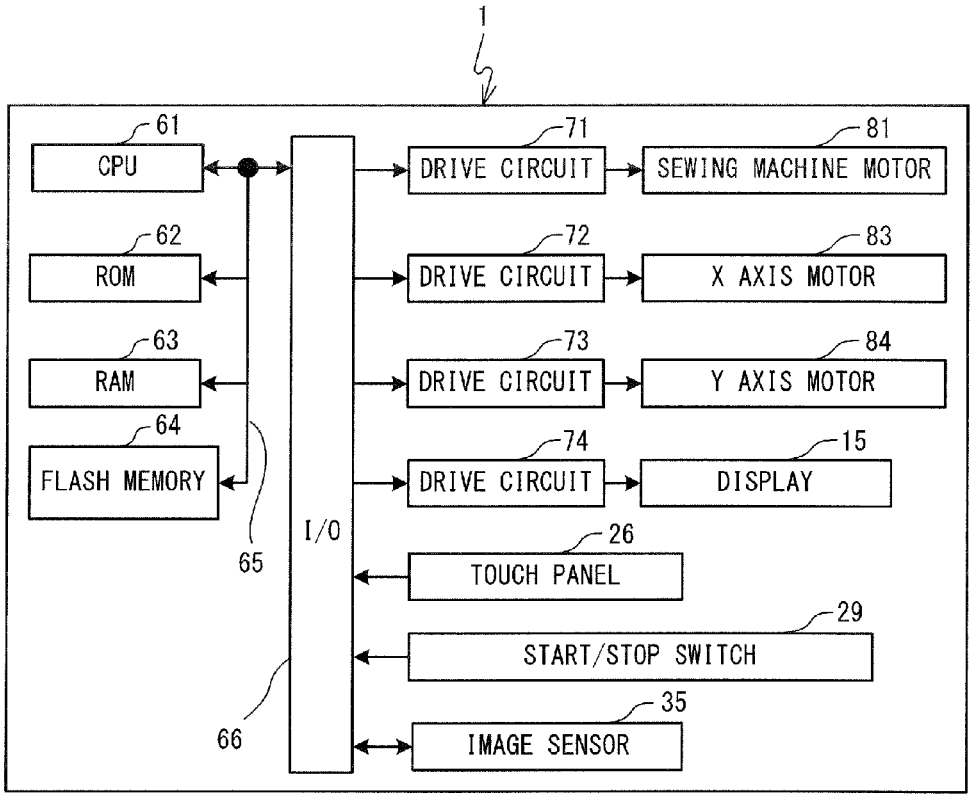
FIG. 3 is a block diagram showing an electrical configuration of the sewing machine.

The main body portion 41 internally includes an X axis movement mechanism (not shown in the drawings) and an X axis motor 83 (refer to FIG. 3). The X axis movement mechanism may move the carriage 42 in the left-right direction (an X axis direction). By the carriage 42 being moved in the left-right direction, the embroidery frame 50 may move the sewing workpiece 3 in the left-right direction. The X axis motor 83 may drive the X axis movement mechanism. The movement mechanism 40 may move the embroidery frame 50 mounted on the carriage 42 to a position indicated by a unique XY coordinate system (an embroidery coordinate system). The right direction, the left direction, the front direction, and the rear direction of the sewing machine 1 respectively correspond to an X plus direction, an X minus direction, a Y plus direction, and a Y minus direction of the embroidery coordinate system.

The display 15 is provided on the front surface of the pillar 12. An image including various items, such as a command, an illustration, a setting value, a message, etc., may be displayed on the display 15. A touch panel 26, which can detect a pressed position, is provided on the front surface side of the display 15. When the user performs a pressing operation on the touch panel 26 using the user's finger or a stylus pen (not shown in the drawings), the pressed position may be detected by the touch panel 26. A CPU 61 (refer to FIG. 3) of the sewing machine 1 may recognize an item selected on the image, based on the detected pressed position. Hereinafter, the pressing operation on the touch panel 26 by the user is referred to as a panel operation. By a panel operation, the user may select an embroidery pattern that the user desires to sew or may select a command to be executed etc. A sewing machine motor 81 (refer to FIG. 3) is provided inside the pillar 12.

A cover 16 is provided on an upper portion of the arm 13 such that the cover 16 may open and close. In FIG. 1, the cover 16 is in an open state. A thread storage portion 18 is provided below the cover 16, that is, inside the arm 13. The thread storage portion 18 may house a thread spool 20 on which the upper thread is wound. The drive shaft (not shown in the drawings), which extends in the left-right direction, is provided inside the arm 13. The drive shaft may be rotationally driven by the sewing machine motor 81. Various switches, including a start/stop switch 29, are provided on the lower left portion of the front surface of the arm 13. The start/stop switch 29 is used to input an instruction to start or stop the operation of the sewing machine 1, namely, to start or stop sewing.

Figure 2:
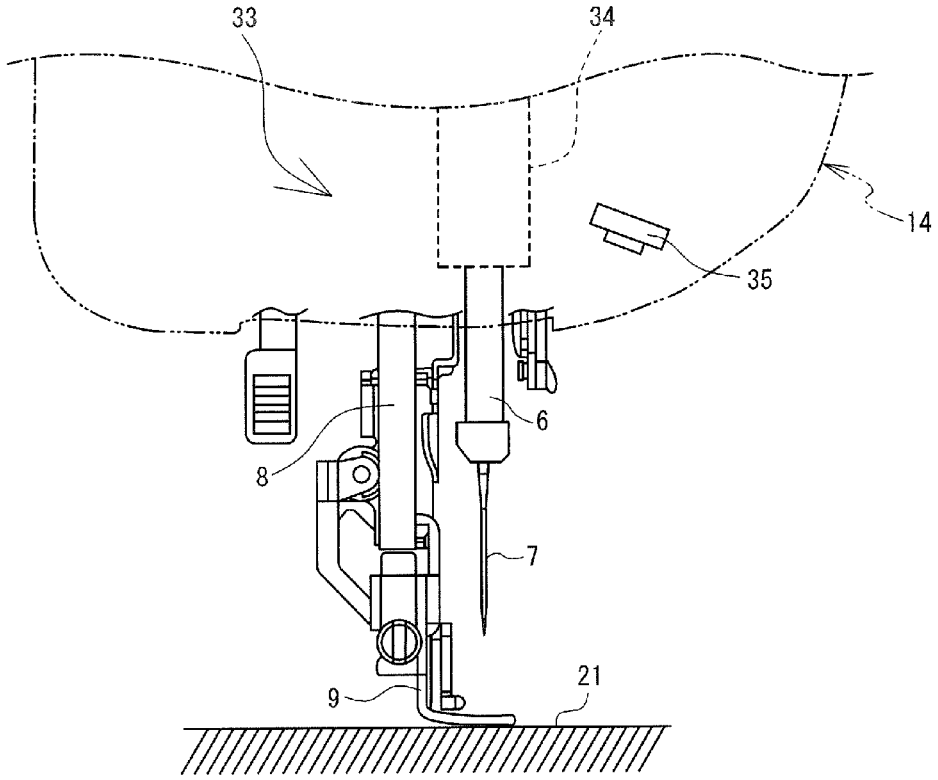
FIG. 2 is an explanatory diagram showing a configuration of a lower end portion of a head.

As shown in FIG. 2, the needle bar 6, a presser bar 8, a needle bar up-and-down movement mechanism 34, etc. are provided on the head 14. The needle bar 6 and the presser bar 8 extend downward from the lower end portion of the head 14. A sewing needle 7 may be removably attached to the lower end of the needle bar 6. The presser foot 9 may be removably attached to the lower end portion of the presser bar 8. The needle bar 6 is provided on the lower end of the needle bar up-and-down movement mechanism 34. The needle bar up-and-down movement mechanism 34 may drive the needle bar 6 in the up-down direction as a result of the rotation of the drive shaft. The sewing machine 1 includes the needle bar 6, the needle bar up-and-down movement mechanism 34, and the sewing machine motor 81 (refer to FIG. 3) as a sewing portion 33.

An image sensor 35 is provided inside the head 14. The image sensor 35 is, for example, a known complementary metal oxide semiconductor (CMOS) image sensor. The image sensor 35 may capture an image of a specified area and may output image data of the captured image. The output image data may be stored in a specified storage area of a RAM 63 (refer to FIG. 3). The image sensor 35 of the present embodiment may capture an image of a rectangular area that is smaller than a sewing area. The sewing area is an area in which stitches of an embroidery pattern may be formed. The sewing area is set as a rectangular shape inside the inner frame of the embroidery frame 50. A coordinate system of the captured image represented by the image data generated by the image sensor 35 and a whole space coordinate system are associated with each other in advance using parameters stored in a flash memory 64. Hereinafter, the whole space coordinate system is referred to as the world coordinate system. The world coordinate system and an embroidery coordinate system are associated with each other in advance using parameters stored in the flash memory 64. As a result, the sewing machine 1 may perform processing that identifies coordinates of the embroidery coordinate system based on the image data. The sewing machine 1 may thus identify, from the captured image, a sewing position of a sewing target on the sewing workpiece 3.

A sewing operation of the sewing machine 1 will be briefly explained. When the embroidery pattern is sewn, the needle bar up-down movement mechanism 34 and the shuttle mechanism (not shown in the drawings) may be driven in synchronization with the movement of the embroidery frame 50 that is moved in the left-right direction (the X axis direction) and the front-rear direction (the Y axis direction) by the movement mechanism 40. In this manner, the embroidery pattern may be sewn on the sewing workpiece 3 held by the embroidery frame 50, by the sewing needle 7 mounted on the needle bar 6. When a normal practical pattern, which is not the embroidery pattern, is sewn, the sewing may be performed while the sewing workpiece 3 is fed by the feed dog (not shown in the drawings), in a state in which the movement mechanism 40 is removed from the bed 11.

The electrical configuration of the sewing machine 1 will be explained with reference to FIG. 3. As shown in FIG. 3, the sewing machine 1 includes the CPU 61 as well as a ROM 62, the RAM 63, a flash memory 64, and an input/output interface (I/O) 66, which are each connected to the CPU 61 by a bus 65.

The CPU 61 performs overall control of the sewing machine 1 and executes various arithmetic calculations and processing relating to sewing, in accordance with various programs stored in the ROM 62. The ROM 62 stores the various programs to operate the sewing machine 1. The programs stored in the ROM 62 include, for example, a program that causes the sewing machine 1 to perform pattern sewing processing, which will be explained below.

The RAM 63 includes a storage area to store calculation results etc. of arithmetic processing by the CPU 61 as necessary. The flash memory 64 stores the various parameters and the like that are used for the sewing machine 1 to perform the various processing. The flash memory 64 also stores an associated data table 90 (refer to FIG. 4), a parameter data table 91 (refer to FIG. 6), and a reference stitch feature quantity, all of which will be explained below. The reference stitch feature quantity is a local feature quantity indicating a stitch type of the embroidery pattern. The stitch type is, for example, satin stitch, cross stitch etc. The local feature quantity will be explained below. Drive circuits 71 to 74, the touch panel 26, the start/stop switch 29, and the image sensor 35 are connected to the I/O 66.

The sewing machine motor 81 is connected to the drive circuit 71. The drive circuit 71 may drive the sewing machine motor 81 in accordance with a control signal from the CPU 61. The needle bar up-and-down movement mechanism 34 may be driven via the drive shaft (not shown in the drawings) of the sewing machine 1 in accordance with the driving of the sewing machine motor 81, and the needle bar 6 may be thus moved up and down. The X axis motor 83 is connected to the drive circuit 72. The Y axis motor 84 is connected to the drive circuit 73. The drive circuits 72 and 73 may drive the X axis motor 83 and the Y axis motor 84, respectively, in accordance with a control signal from the CPU 61. The embroidery frame 50 may be moved in the left-right direction (the X axis direction) and in the front-rear direction (the Y axis direction) in accordance with the driving of the X axis motor 83 and the Y axis motor 84, by a movement amount that corresponds to the control signal. The drive circuit 74 may cause an image to be displayed on the display 15 by driving the display 15 in accordance with a control signal from the CPU 61.

The associated data table 90 will be explained with reference to FIG. 4. Embroidery pattern types, embroidery pattern data, local feature quantity sets, histograms, average angle values, and average size values are associated with each other and stored in the associated data table 90. Hereinafter, each of the items will be explained in detail.

The embroidery pattern type is data indicating each type of various shapes of embroidery patterns, such as the letter K, the letter L, a flower, a car, and the like. The plurality of embroidery pattern types are stored in the associated data table 90.

The embroidery pattern data is data that includes information to sew each of the plurality of types of embroidery patterns. Specifically, the embroidery pattern data includes a sewing order, coordinate data, and first thread color information. The coordinate data represents (relative) coordinates, in the embroidery coordinate system, of needle drop points to be used to sew the embroidery pattern. The needle drop point is a point at which the sewing needle 7, from vertically above the needle hole (not shown in the drawings), may pierce the sewing workpiece 3, when the needle bar 6 is moved downward from an upward position. By moving the embroidery frame 50 in the X axis direction and the Y axis direction based on the coordinate data and driving the needle bar 6, the sewing machine 1 sews the embroidery pattern. The first thread color information is information indicating a color of the upper thread to be used to sew the embroidery pattern.

The local feature quantity set is a set of a plurality of local feature quantities in the embroidery pattern. The local feature quantity is a known parameter indicating a feature. For example, a local feature quantity is disclosed in "Gradient-Based Feature Extraction SIFT and HOG, Hironobu Fujiyoshi, Information Processing Society of Japan, Research Report CVIM 160, pp. 211 to 224, September 2007" (hereinafter referred to as Reference Literature 1), the relevant portions of which are incorporated by reference.

Figure 5:
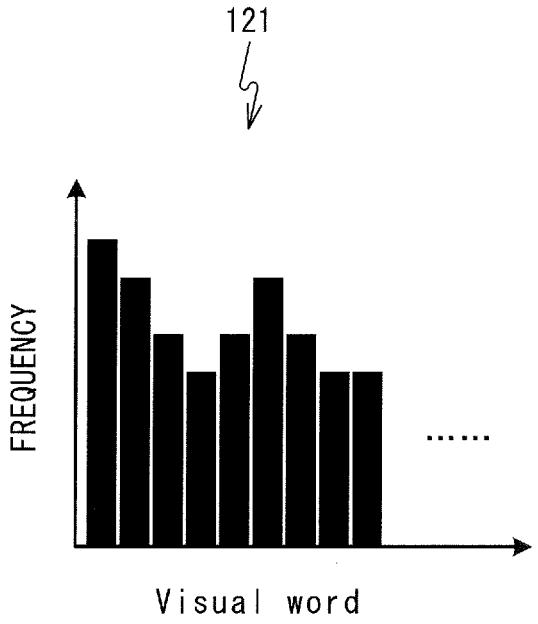
FIG. 5 is a diagram showing a first histogram.

The histogram is generated based on the local feature quantity. A method of generating the histogram is disclosed in Reference Literature 1, for example, and is briefly explained here. The CPU 61 extracts local feature points and feature areas from a reference image in which the embroidery pattern is captured, and calculates the local feature quantity. The CPU 61 carries out vector quantization on the local feature quantity. The vector-quantized local feature quantity is called a visual word. The histogram is generated from the visual word obtained from a single reference image. An example of the histogram is a first histogram 121 shown in FIG. 5. The first histogram 121 is a histogram for the embroidery pattern type of the letter K. The horizontal axis is the visual word and the vertical axis is a frequency. In the present embodiment, the histograms generated in advance for the individual embroidery patterns are stored in the associated data table 90. The histogram is different for each of the embroidery patterns.

The average angle value is an average value of angles of luminance gradient directions of a plurality of local feature points. The average size value is an average value of sizes of feature areas (to be explained below).

The parameter data table 91 will be explained with reference to FIG. 6. The embroidery pattern types and editing parameters are associated with each other in the parameter data table 91. The editing parameters are parameters used in editing the embroidery pattern data. In the present embodiment, it is assumed that the editing parameters are a sewing position, a size, and a rotation angle of the embroidery pattern.

Figure 7:
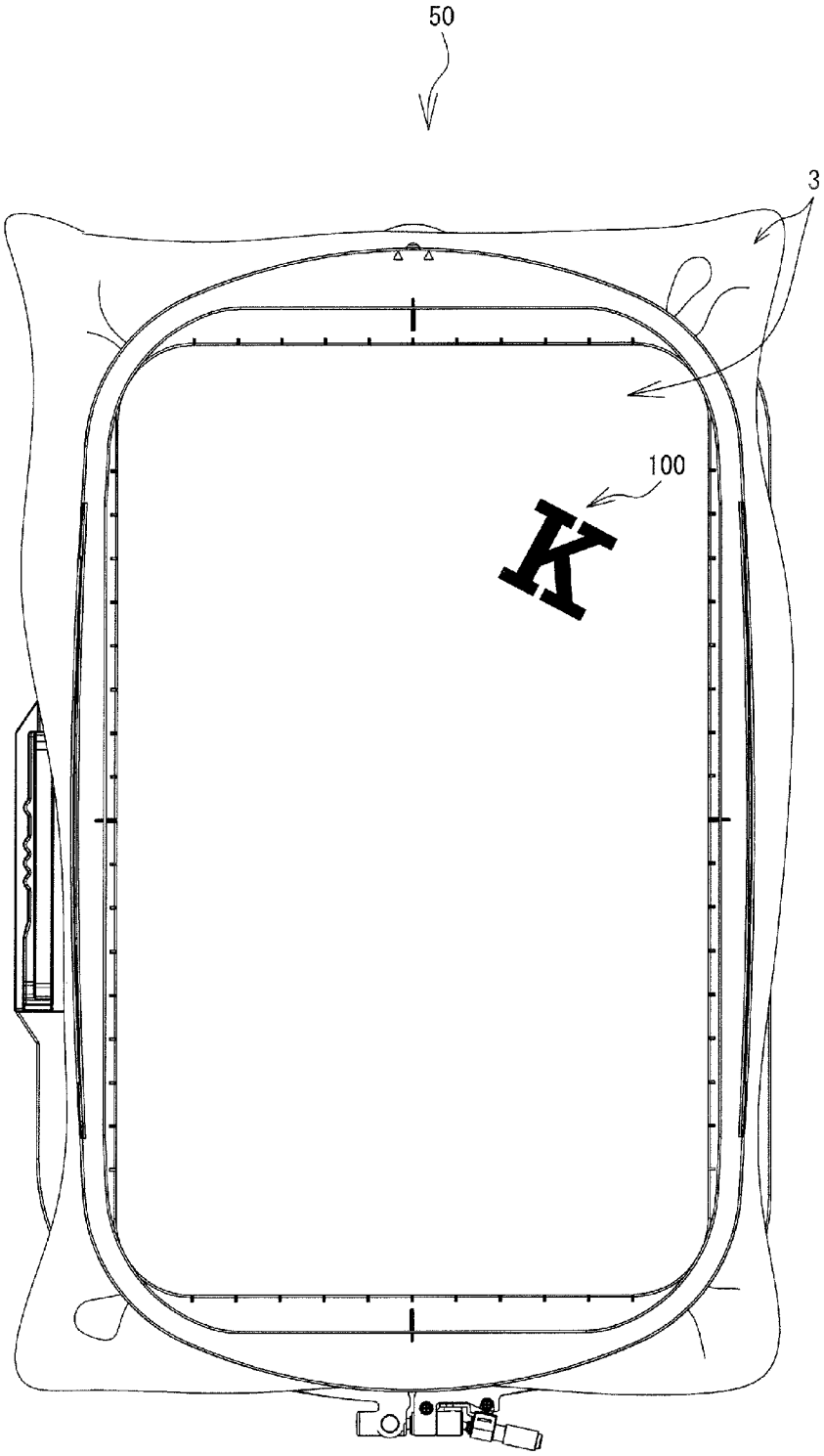
FIG. 7 is a plan view of an embroidery frame in which is arranged a sewing workpiece on which an embroidery pattern has been sewn.

Registration of data in the parameter data table 91 will be explained. When a user performs sewing of the embroidery pattern, the user may perform a panel operation, for example, and thus may select a desired embroidery pattern from among the plurality of embroidery patterns stored in the flash memory 64. The user may specify the sewing position, the size, and the rotation angle of the embroidery pattern, with respect to the sewing workpiece 3 held by the embroidery frame 50. Further, the user may specify a stitch type to be used for sewing the embroidery pattern. The CPU 61 adjusts the embroidery pattern data based on the editing parameters that include the specified sewing position, size, and rotation angle. The CPU 61 performs sewing using the specified stitch type. The CPU 61 associates the embroidery pattern type with the editing parameters and registers the associated data in the parameter data table 91. Specifically, the registered type of the sewn embroidery pattern and the registered editing parameters thereof are sequentially accumulated in the parameter data table 91. An embroidery pattern 100 shown in FIG. 7 is, an embroidery pattern in which the embroidery pattern of the letter K is sewn using the editing parameters of a sewing position (X1, Y1), a size of 1.2 times, and a rotation angle of −30 degrees as well as the stitch type of satin stitch. These editing parameters may be first editing parameters in the parameter data table 91. For the direction of the rotation angle, a counter-clockwise rotational direction in a plan view is a plus direction and a clockwise rotational direction in a plan view is a minus direction.

The pattern sewing processing will be explained with reference to FIG. 8 and FIG. 9. The pattern sewing processing is processing in which the embroidery pattern type and the editing parameters are identified based on the embroidery pattern sewn on the sewing workpiece 3, and the identified editing parameters are used to perform sewing of the embroidery pattern. In the following explanation, a case is given as a specific example in which the embroidery pattern 100 shown in FIG. 7 is captured by the image sensor 35, the editing parameters are identified and the embroidery pattern is sewn.

When the CPU 61 detects a command to start the processing, the CPU 61 reads out, from the program storage area of the ROM 62 shown in FIG. 3 to the RAM 63, a program to perform the pattern sewing processing, and performs steps of the processing explained below in accordance with instructions included in the program. During the processing, various data may be stored as appropriate in the RAM 63. The pattern sewing processing may be started in a state in which the sewing workpiece 3 on which the embroidery pattern is sewn is held by the embroidery frame 50 and the embroidery frame 50 is mounted on the movement mechanism 40. Hereinafter, step is abbreviated to S.

Figure 8:
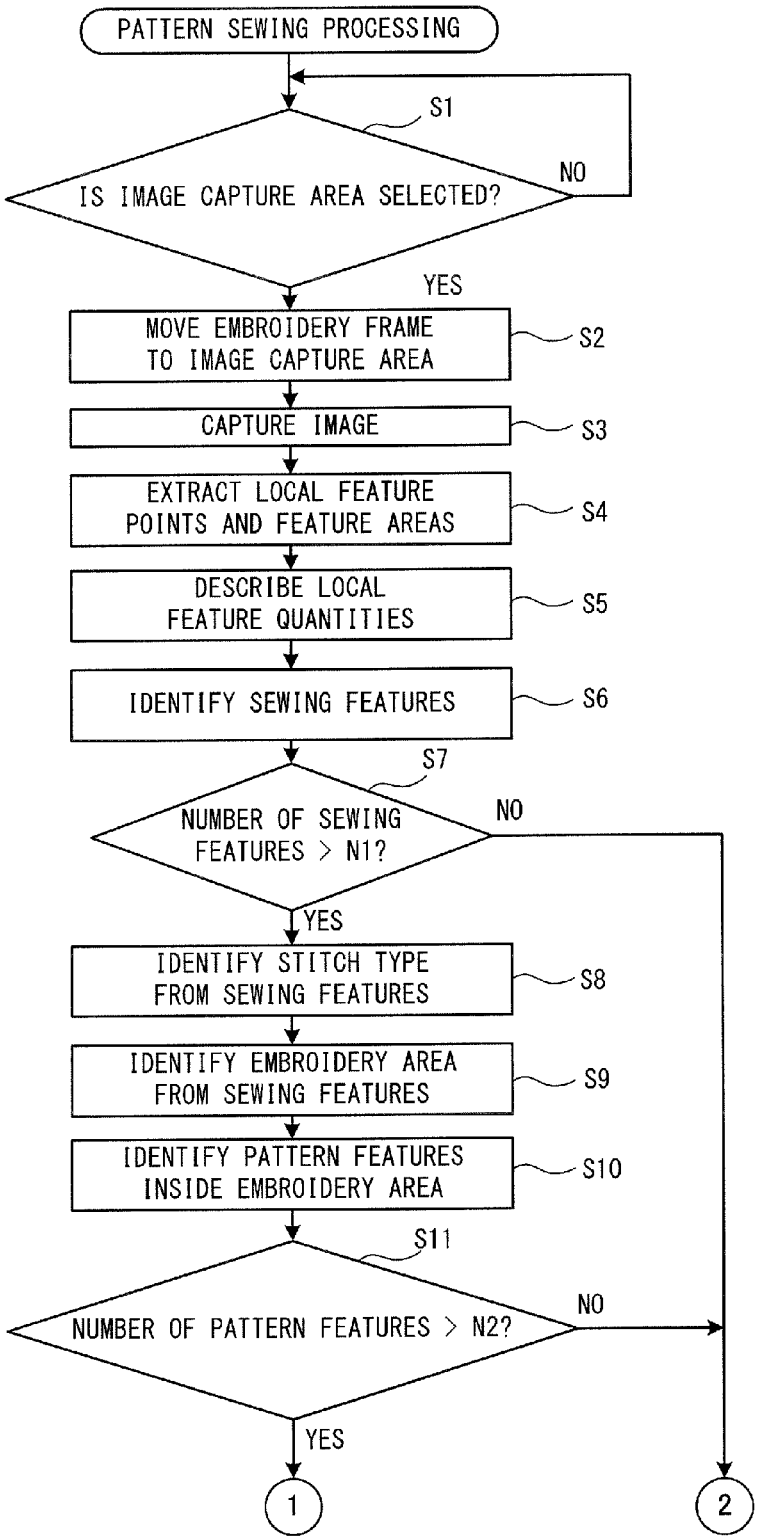
FIG. 8 is a flowchart of embroidery sewing processing.
Figure 9:
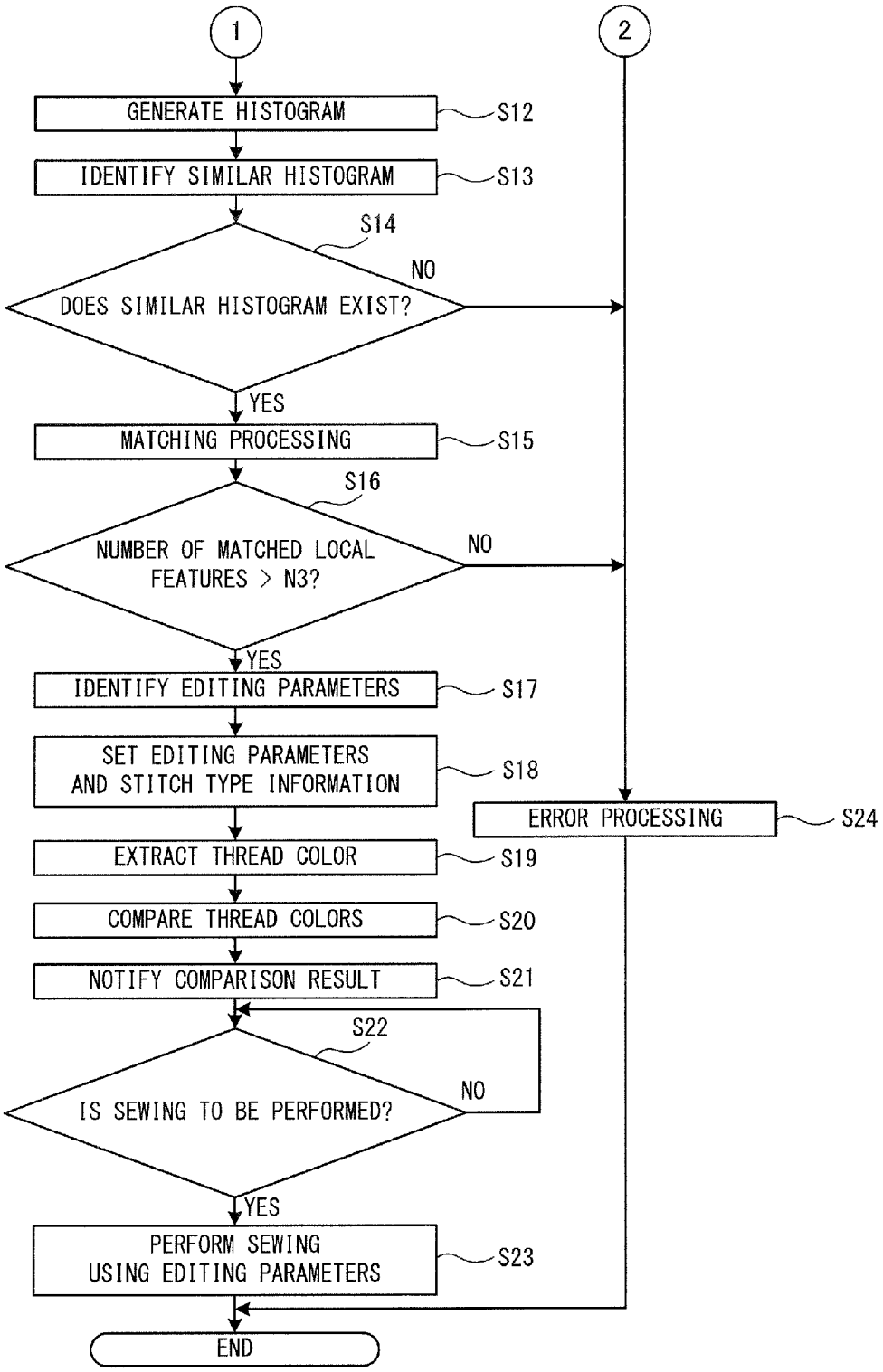
FIG. 9 is a flowchart of the embroidery sewing processing and is a continuation of FIG. 8.

As shown in FIG. 8, the CPU 61 is on stand-by until the CPU 61 detects selection of an image capture area (no at S1). Although not shown in the drawings, an image that shows an outer shape of the embroidery frame 50 is displayed on the display 15, based on image data that indicates the outer shape of the embroidery frame 50 and that is stored in the ROM 62. The user may select the image capture area, which includes a part of an area inside the embroidery frame 50 that is to be captured by the image sensor 35, by a panel operation. The CPU 61 detects, for example, that an area including the embroidery pattern 100 shown in FIG. 7 is selected as the image capture area (yes at S1). In this case, the CPU 61 moves the embroidery frame 50 to a position in which the selected image capture area can be captured (S2).

Figure 10:
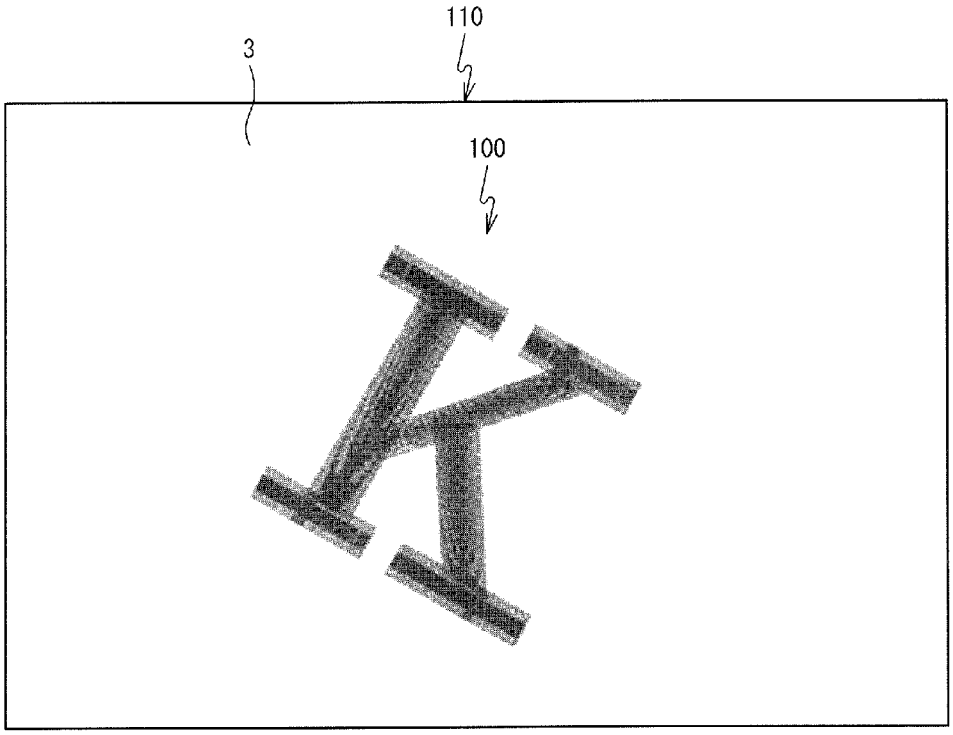
FIG. 10 is a captured image that includes the embroidery pattern.

The CPU 61 controls the image sensor 35 to capture, as a captured image 110 (refer to FIG. 10), an image that includes the embroidery pattern 100 sewn on the sewing workpiece 3 (S3). Next, the CPU 61 performs processing at S4 and S5, and calculates a local feature quantity from the captured image 110 captured at S3. For example, processing to calculate the local feature quantity is disclosed in Reference Literature 1 and Japanese Patent No. 4988408 (hereinafter referred to as Reference Literature 2), the relevant portions of which are incorporated by reference. The processing to calculate the local feature quantity will therefore be only briefly explained here.

Figure 11:
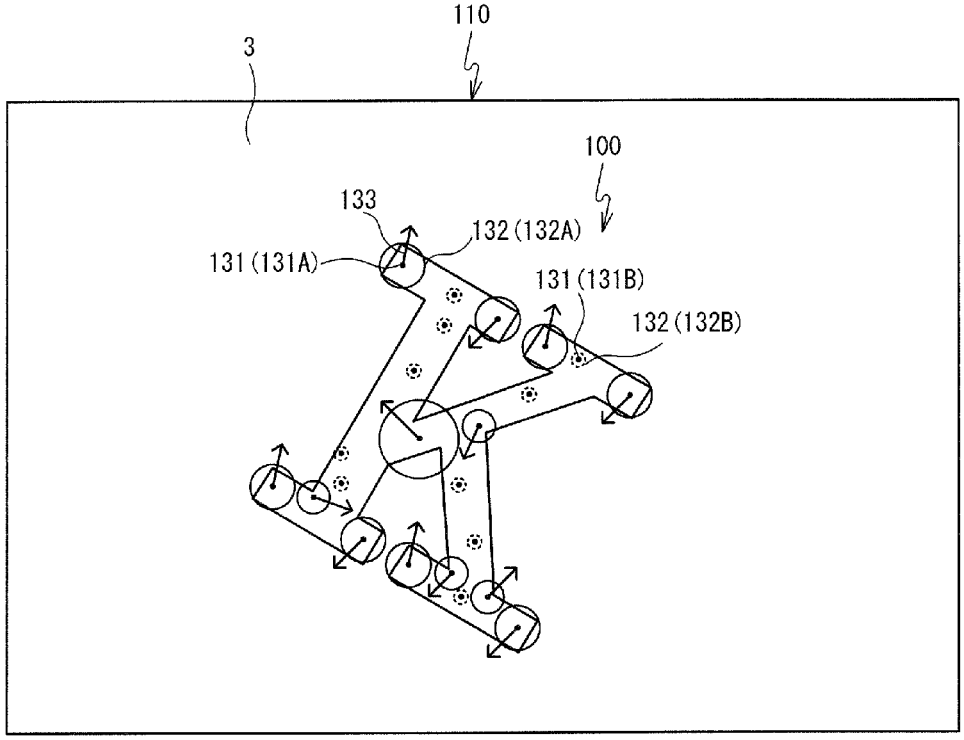
FIG. 11 is the captured image showing positions of local features.

The CPU 61 extracts local feature points 131 and feature areas 132, which are shown in FIG. 11, from the captured image 110 captured at S3 (S4). More specifically, the CPU 61 generates multi-resolution smoothed images with respect to the captured image 110. Next, the CPU 61 applies a difference of Gaussians (DoG) filter to a plurality of the smoothed images having different scales, and acquires a DoG image, which is an output image of the DoG filter. Next, when a target point (target pixel) in the DoG image has an extreme value (one of a maximum value and a minimum value) in a surrounding area of the target point, the target point is designated as the local feature point 131 and the surrounding area is designated as the feature area 132, as shown in FIG. 11. The local feature point 131 tends to be a point at which there are many changes in luminance in the feature area 132. In FIG. 11, in order to make the figure easy to understand, only a contour of the embroidery pattern 100 is shown. Further, in order to make the figure easy to understand, reference numerals are assigned to only some of the local feature points 131 and feature areas 132 are shown in FIG. 11. In addition, in order to make the figure easy to understand, in FIG. 11, only some of the local feature points 131 and feature areas 132 that are extracted at S4 are shown.

The local feature points 131 include a local feature point 131A and a local feature point 131B. The feature areas 132 include a feature area 132A, which has the local feature point 131A as its center, and a feature area 132B, which has the local feature point 131B as its center. In FIG. 11, the feature area 132A is depicted by a solid line circle. The feature area 132B is depicted by a dotted line circle. The local feature point 131B is the local feature point 131 for which the feature area 132B is smaller than a specified size. Many of the local feature points 131B appear in a section inside the embroidery pattern 100. Therefore, the local feature point 131B and the feature area 132E represent a feature of the stitch type of the embroidery pattern 100 that is sewn on the sewing workpiece 3. The local feature point 131A is the local feature point 131 for which the feature area 132A is equal to or larger than the specified size. Many of the local feature points 131A appear in a characteristic part of the shape of the embroidery pattern 100. Therefore, the local feature point 131A and the feature area 132A represent a feature of the type of the embroidery pattern 100 that is sewn on the sewing workpiece 3. In the following explanation, when the local feature point 131B and the feature area 132B are collectively referred to or when either of them is not specified, the local feature point 131B and the feature area 132B are referred to as a sewing feature. When the local feature point 131A and the feature area 132A are collectively referred to or when either of them is not specified, the local feature point 131A and the feature area 132A are referred to as a pattern feature. When the local feature point 131 and the feature area 132 are collectively referred to or when either of them is not specified, the local feature point 131 and the feature area 132 are referred to as a local feature.

Next, the CPU 61 performs processing to describe (calculate) the local feature quantities (S5). At S5, the CPU 61 first calculates a luminance gradient and a luminance gradient direction, for the pixels inside the feature area 132 that centers on the single local feature point 131. From a magnitude of the luminance gradient and the luminance gradient direction that have been calculated, the CPU 61 generates a histogram, for example, that is divided into 36 directions and that is weighted. From the generated 36-direction histogram, the CPU 61 allocates, as a reference gradient direction of the local feature point 131, a direction having a peak value. Next, the CPU 61 performs normalization of degree (a rotation direction). Specifically, the CPU 61 rotates the feature area 132 surrounding the local feature point 131 in the reference gradient direction of that local feature point 131. By performing the normalization of degree in this manner, the CPU 61 can obtain the local feature quantity that is rotation invariant.

Next, the CPU 61 uses a Gaussian window to perform weighting such that a greater value is assigned in the vicinity of the center of the feature area 132. The size of the Gaussian window is determined by a smoothing scale of the DoG image from which the local feature point 131 is extracted. Therefore, when the size of the embroidery pattern 100 in the captured image 110 is doubled, for example, the scale is also doubled and the local feature quantity in the same area is obtained. In this way, it is possible to obtain the local feature quantity that is invariant to changes of scale.

Next, the CPU 61 divides the feature area 132 into 16 (4×4) areas and generates an 8-direction histogram for each of the divided areas. As a result, the CPU 61 can describe the local feature quantity of a 128-dimensional vector that is invariant to changes of scale. By performing the above-described processing on all of the local feature points 131, the CPU 61 calculates the local feature quantities for all of the local feature points 131.

Of the local features extracted at S4, by identifying the local features for the feature area 132 that are smaller than the specified size, the CPU 61 identifies the sewing features (S6). The CPU 61 determines whether the number of the sewing features identified at S6 is larger than a specified number N1 (S7). The specified number N1 is 30, for example. When the number of the sewing features is not larger than the specified number N1 (no at S7), the CPU 61 performs error processing (S24). The error processing is processing to notify an operator that the embroidery pattern 100 cannot be recognized. In the error processing, for example, a message stating "The embroidery pattern cannot be recognized" may be displayed on the display 15. The CPU 61 then ends the pattern sewing processing.

When the number of the sewing features is larger than the specified number N1 (yes at S7), the CPU 61 identifies the stitch type of the embroidery pattern 100 that is sewn on the sewing workpiece 3 (S8). More specifically, of the local feature quantities calculated at S5, the CPU 61 extracts the local feature quantity of the sewing features identified at S6. The CPU 61 compares the extracted local feature quantity of the sewing features with reference stitch feature quantities stored in the flash memory 64 and identifies the reference stitch feature quantity that is approximate to the extracted local feature quantity of the sewing features. The CPU 61 identifies the stitch type corresponding to the identified reference stitch feature quantity. In the case of the specific example, satin stitch is identified as the stitch type.

The CPU 61 identifies an embroidery area based on the sewing features (S9). Although only some of the sewing features are illustrated in FIG. 11, the local feature points 131B and the feature areas 132B, which are the sewing features, are concentrated inside the embroidery pattern 100. Therefore, by identifying an area in which the sewing features are concentrated, the CPU 61 can identify the embroidery area. In this manner, the CPU 61 identifies, as the embroidery area, an area inside the letter K that is the embroidery pattern 100.

The CPU 61 identifies the pattern features inside the embroidery area identified at S9 (S10). In this way, it is possible to exclude the local features (not illustrated in FIG. 11) that are in a different position to the embroidery pattern 100.

Next, the CPU 61 determines whether the number of the pattern features identified at S10 is larger than a specified number N2 (S11). The specified number N2 is 30, for example. When the number of the pattern features is not larger than the specified number N2 (no at S11), the CPU 61 performs the error processing (S24). The CPU 61 then ends the pattern sewing processing.

Figure 12:
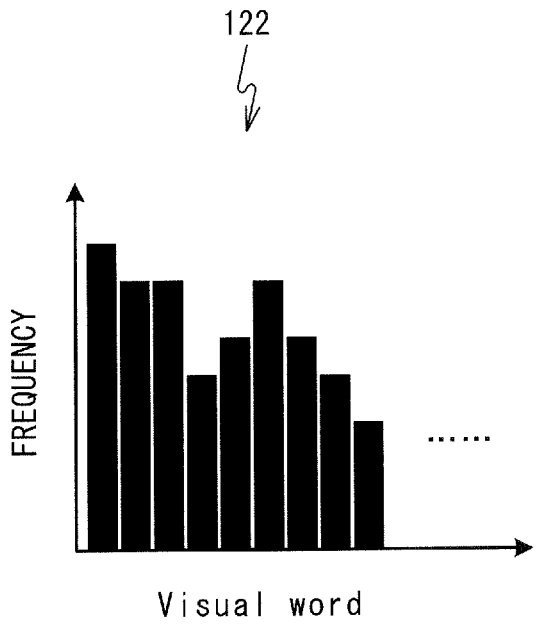
FIG. 12 is a diagram showing a histogram.

When the number of the pattern features is larger than the specified number N2 (yes at S11), the CPU 61 generates a histogram, using the local feature quantities of the pattern features identified at S10, from among the local feature quantities calculated at S5 (S12). A method of generating the histogram is substantially the same as the case described above. A histogram 122, which is an example of the generated histogram, is shown in FIG. 12.

The CPU 61 compares the histogram 122 (refer to FIG. 12) generated at S11 with the histograms registered in the associated data table 90, and identifies the histogram that is stored in the associated data table 90 and that is similar to the histogram 122 generated at S11 (S13). For example, the CPU 61 calculates a difference in frequency for each corresponding visual word, for the histograms stored in the associated data table 90 and the histogram 122 generated at S11. The CPU 61 divides the difference by the number of visual words. The CPU 61 uses the calculated value as a degree of similarity. Of the histograms registered in the associated data table 90, the CPU 61 identifies the histogram for which the value of the degree of similarity is smallest and is smaller than a specified value. Thus, the CPU 61 identifies the histogram that is similar to the histogram 122. In the specific example, the CPU 61 may identify the first histogram 121 (refer to FIG. 4 and FIG. 5) that is registered in the associated data table 90. When the similar histogram is not identified (no at S14), the CPU 61 performs the error processing (S24). The CPU 61 then ends the pattern sewing processing.

When the similar histogram is identified (yes at S14), the CPU 61 performs matching processing (S15). In the matching processing, from among the local feature quantity sets registered in the associated data table 90, the CPU 61 extracts a first feature quantity set that corresponds to the first histogram 121 identified at S13. Of the local feature quantities calculated at S5, the CPU 61 performs matching of the local feature quantities of the pattern features identified at S10 and the local feature quantities included in the first feature quantity set. The CPU 61 identifies the local features that have been successfully matched.

The CPU 61 determines whether the number of the local features that have been successfully matched at S15 is larger than a specified number N3 (S16). The specified number. N3 is 30, for example. In the specific example, the number of local features that have been successfully matched may be larger than the specified number N3. Therefore, the embroidery pattern sewn on the sewing workpiece 3 may be identified as the embroidery pattern 100 of the letter K. When the number of local features that have been successfully matched is not larger than the specified number N3 (no at S16), the CPU 61 performs the error processing (S24). The CPU 61 then ends the pattern sewing processing.

When the number of the local features that have been successfully matched is larger than the specified number N3 (yes at S16), the CPU 61 uses the local features that have been successfully matched to identify editing parameters (S17). More specifically, the CPU 61 calculates a gravity center of the coordinates of the local feature points 131 of the local features that have been successfully matched, in the captured image 110. Based on a movement amount by which the embroidery frame 50 has been moved at S2 and the coordinates of the gravity center in the captured image 110, the CPU 61 calculates a sewing position of the embroidery pattern 100 on the sewing workpiece 3. Further, the CPU 61 calculates an average value of angles of the luminance gradient directions of the local features that have been successfully matched. The luminance gradient directions are indicated by arrows 133 in FIG. 11. In order to make the drawing easy to understand, the reference numerals of the arrows 133 are assigned for only some of the luminance gradient directions in FIG. 11.

Based on a difference between the calculated average value of the angles of the luminance gradient directions and the average angle value registered in the associated data table 90 (refer to FIG. 4), the CPU 61 calculates a rotation angle of the embroidery pattern 100. Further, the CPU 61 calculates an average value of the sizes of the feature areas 132A of the local features that have been successfully matched. Based on a difference between the calculated average value of the sizes and the average size value registered in the associated data table 90 (refer to FIG. 4), the CPU 61 calculates the size of the embroidery pattern 100. In the present embodiment, the size of the embroidery pattern 100 is a ratio of one of enlargement and contraction of the embroidery pattern 100. In the specific example, a sewing position (X1, Y1), a rotation angle of −30 degrees, and a size of 1.2 times may be calculated as the editing parameters. Next, of the editing parameters registered in the parameter data table 91 (refer to FIG. 6), the CPU 61 identifies the editing parameters that are closest to the calculated editing parameters. In the specific example, the first editing parameters, which are the sewing position (X1, Y1), the rotation angle of −30 degrees, and the size of 1.2 times may be identified (S17).

The CPU 61 stores in the RAM 63 the first editing parameters identified at S17, and the stitch type identified at S8 (S18). In this way, the first editing parameters and the stitch type are set in the sewing machine 1 (S18). The CPU 61 extracts second thread color information from the captured image 110 (S19). The second thread color information is information indicating a color of the upper thread of the embroidery pattern 100. The CPU 61 compares the first thread color information included in the embroidery pattern data of the embroidery pattern 100 stored in the flash memory 64 with the second thread color information extracted at S19 (S20). The CPU 61 performs notification of the comparison result at S20 (S21). When, as a result of the comparison at S20, the first thread color information and the second thread color information are different, for example, a message stating "The upper thread color is different to the sewing data" may be displayed on the display 15.

When the notification of the comparison result is performed at S21, the user may easily recognize a difference of the color of the upper thread based on the thread color information in the embroidery pattern data and the color of the upper thread sewn on the sewing workpiece 3. Thus, the user may change the color of the upper thread to be the same as the color of the sewn upper thread, for example.

The CPU 61 is on stand-by until the CPU 61 detects a command to perform sewing (no at S22). The user may dispose a new sewing workpiece 3, on which the embroidery pattern has not been sewn, on the embroidery frame 50. The user may input the command to the sewing machine 1 to perform the sewing by operating the start/stop switch 29. When the CPU 61 detects the command to perform the sewing (yes at S22), the CPU 61 performs the sewing (S23). The CPU 61 uses the first editing parameters identified at S17 and sews the embroidery pattern 100 identified by the processing from S13 to S16. At this time, the sewing is performed using the stitch type identified at S8. In this way, the embroidery pattern that is the same as the embroidery pattern 100 shown in FIG. 7 may be sewn on the new sewing workpiece 3.

As described above, in the present embodiment, it is possible to automatically identify the embroidery pattern 100 and the first editing parameters, from the captured image 110 of the sewing workpiece 3 on which the embroidery pattern 100 has been sewn. Thus, the embroidery pattern 100 and the first editing parameters can be more easily identified than a case in which the user operates the sewing machine 1 to identify the embroidery pattern 100 sewn in the past and the first editing parameters.

In the present embodiment, the embroidery pattern 100 can be identified based on the degree of similarity between the first histogram 121 and the histogram 122.

In addition to the embroidery pattern 100 and the first editing parameters, the CPU 61 can identify the stitch type (the satin stitch, for example) (S8). Therefore, the embroidery pattern, the editing parameters, and the stitch type can be more easily identified in comparison to the case in which the user operates the sewing machine 1 to identify the embroidery pattern 100 sewn in the past, the first editing parameters, and the stitch type.

Various changes may be made to the above-described embodiment. In the above-described embodiment, the stitch type is identified at S8, but the stitch type need not necessarily be identified. In this case, the processing at S6 and S7 need not necessarily be performed. Further, in this case, the identification of the embroidery area at S9 may be performed using another method. For example, the embroidery area need not be identified based on the sewing features and the embroidery area may be identified based on the pattern features.

In the above-described embodiment, the embroidery pattern is identified using the histogram, but the histogram need not necessarily be used. For example, the CPU 61 may perform matching of the local feature quantities of the pattern features and the local feature quantity sets of the associated data table 90. Then, by identifying the similar local feature quantity set, the CPU 61 may identify the embroidery pattern.

It is sufficient if the embroidery pattern is identified based on information indicating the feature of the embroidery pattern, and the information indicating the feature of the embroidery pattern need not necessarily be the histogram and the local feature quantities. For example, the information indicating the embroidery pattern may be information about a shape of the embroidery pattern in the captured image. In this case, the CPU 61 may extract the information about the shape of the embroidery pattern 100 from the captured image 110. Then, the CPU 61 may compare the extracted information about the shape of the embroidery pattern 100 with information about a shape of an embroidery pattern stored in the associated data table 90, and thus calculate a degree of similarity and identify the embroidery pattern. In this case, the degree of similarity may be parameters based on the information about the shape of the embroidery pattern. It is sufficient if the editing parameters include at least one of the sewing position, the size, and the rotation angle of the embroidery pattern. In this case, at least one of the sewing position, the size, and the rotation angle can be easily identified.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

a sewing portion configured to sew an embroidery pattern on a sewing workpiece;

an image capturing portion configured to capture an image;

a first memory configured to store embroidery pattern data, editing parameters, and first feature information, the embroidery pattern data including information for sewing respective types of embroidery patterns, the editing parameters being parameters used to edit the embroidery pattern data corresponding to the respective types of embroidery patterns, and the first feature information being information that indicates features of the respective types of embroidery patterns;

a processor; and a second memory configured to store computer-readable instructions, wherein the computer-readable instructions, when executed by the processor, cause the sewing machine to perform processes comprising:

causing the image capturing portion to capture an image including the embroidery pattern sewn on the sewing workpiece;

extracting second feature information from a captured image, the second feature information being information that indicates a feature of the sewn embroidery pattern, and the captured image being the image captured by the image capturing portion;

identifying the sewn embroidery pattern, based on the first feature information stored in the first memory and the extracted second feature information;

identifying an editing parameter corresponding to the identified embroidery pattern, from among the editing parameters stored in the first memory; and causing the sewing portion to sew the identified embroidery pattern using the identified editing parameter.

2. The sewing machine according to claim 1, further comprising:

a third memory configured to store stitch type information being information that indicates a stitch type of the embroidery pattern;

wherein the computer-readable instructions, when executed by the processor, further cause the sewing machine to perform processes comprising:

extracting stitch feature information from the captured image, the stitch feature information being information that indicates a stitch feature of the sewn embroidery pattern; and identifying a stitch type of the sewn embroidery pattern, based on the stitch type information stored in the third memory and the extracted stitch feature information, and the causing the sewing portion to sew the identified embroidery pattern includes causing the sewing portion to sew the embroidery pattern using the identified stitch type.

3. The sewing machine according to claim 1, further comprising:

a notification portion configured to notify information relating to sewing, wherein the embroidery pattern data further includes first thread color information, the first thread color information being information that indicates a color of an upper thread to be used in sewing, and the computer-readable instructions, when executed by the processor, further cause the sewing machine to perform processes comprising:

extracting second thread color information from the captured image, the second thread color information being information that indicates a color of an upper thread of the sewn embroidery pattern;

comparing the first thread color information stored in the first memory with the extracted second thread color information; and causing the notification portion to notify a result of comparison of the first thread color information and the second thread color information.

4. The sewing machine according to claim 1, wherein the identifying the sewn embroidery pattern includes identifying the sewn embroidery pattern based on calculation of a degree of similarity between the first feature information and the second feature information.

5. The sewing machine according to claim 4, wherein the first memory stores first histograms as the first feature information, the respective first histograms indicating features of the respective types of embroidery patterns;

the extracting the second feature information includes extracting a second histogram as the second feature information, the second histogram indicating a feature of the sewn embroidery pattern; and the identifying the sewn embroidery pattern includes identifying the sewn embroidery pattern based on calculation of a degree of similarity between at least one of the first histograms and the second histogram.

6. The sewing machine according to claim 1, wherein the editing parameters include at least one of a sewing position, a size, and a rotation angle of each of the types of embroidery patterns.

* * * * *